US005927189A

United States Patent [19]

Jones et al.

[11] Patent Number: 5,927,189

[45] Date of Patent: Jul. 27, 1999

[54] METHOD AND APPARATUS FOR THERMAL FUSING WITH TWO TEXTURED ENDLESS BELTS

[75] Inventors: Mark Lehi Jones, Atlanta; Lamar Heath Gipson, Acworth, both of Ga.

[73] Assignee: Kimberly-Clark Worldwide, Inc., Neenah, Wis.

[21] Appl. No.: 09/000,755

[22] Filed: Dec. 30, 1997

[51] Int. Cl.[6] ..... B31F 1/07; G03G 15/20

[52] U.S. Cl. ..... 101/23; 101/32; 399/329; 399/333

[58] Field of Search ..... 101/488, 23, 32; 399/338, 328, 329, 333; 347/102; 219/216

[56] References Cited

U.S. PATENT DOCUMENTS

| | | | |
|---|---|---|---|
| 2,681,612 | 6/1954 | Reimann | 101/25 |
| 4,243,869 | 1/1981 | Scribner | 219/216 |
| 4,253,008 | 2/1981 | Dolan | 219/216 |
| 4,931,618 | 6/1990 | Nagata et al. | 219/216 |
| 4,973,824 | 11/1990 | Ohashi et al. | 219/216 |
| 5,010,817 | 4/1991 | Grosshauser | 101/366 |
| 5,157,444 | 10/1992 | Mori et al. | 399/329 |
| 5,157,447 | 10/1992 | Farnand et al. | 399/331 |
| 5,164,782 | 11/1992 | Nagayama et al. | 399/320 |
| 5,196,894 | 3/1993 | Merle et al. | 399/320 |
| 5,311,269 | 5/1994 | Aslam et al. | 399/329 |
| 5,347,348 | 9/1994 | Nagata | 399/329 |
| 5,456,171 | 10/1995 | Biava et al. | 101/DIG. 48 |
| 5,592,276 | 1/1997 | Ohtsuka et al. | 399/335 |
| 5,758,038 | 5/1998 | Itoh et al. | 395/109 |

FOREIGN PATENT DOCUMENTS

| | | | |
|---|---|---|---|
| 805184 | 11/1936 | France | 101/32 |
| 53-113615 | 10/1978 | Japan | 101/32 |

*Primary Examiner*—Edgar Burr
*Assistant Examiner*—Daniel J. Colilla
*Attorney, Agent, or Firm*—Jones & Askew, LLP

[57] ABSTRACT

A fuser apparatus for use with coated media to encapsulate and bond with ink-jet oriented inks. The apparatus includes one or more endless belts to create durable images with a smooth or textured finish on media coated with a fusible coating. In one preferred embodiment, two endless belts are used, each with a different surface texture, to provide the user with two fusible coating texture options, depending upon which way the coated media (e.g. paper) is placed upon the fuser.

13 Claims, 9 Drawing Sheets

SECOND EMBODIMENT
(RIGHT SIDE VIEW)

FOURTH EMBODIMENT
(RIGHT SIDE VIEW)

SECOND EMBODIMENT

FIFTH EMBODIMENT

FIFTH EMBODIMENT
(WITHOUT FUSER COVER)

METHOD AND APPARATUS FOR THERMAL FUSING WITH TWO TEXTURED ENDLESS BELTS

TECHNICAL FIELD

This invention relates in general to printing, more particularly relates to a method and apparatus for thermal fusing, and most particularly relating to a thermal fuser mechanism for creating durable images with a smooth or textured finish on media such as paper coated with a fusible coating.

BACKGROUND OF THE INVENTION

Substrates printed with ink jets are prone to run and smear in the presence of moisture because most ink-jet inks employ aqueous-based systems.

Therefore there is a need in the art for a fusing mechanism and method of using same which can be used with thermally-fusible coatings, to reduce the opportunity for run and smear, which can impart a variety of textures on the fused surfaces.

SUMMARY OF THE INVENTION

The present invention overcomes deficiencies in the prior art by providing an apparatus and method for using same which can be used with thermally-fusible coatings, and can impart a variety of textures on the fused surfaces.

As noted above, substrates printed with ink jets are prone to run and smear in the presence of moisture because most ink-jet inks employ aqueous-based systems. A fusible, printable coating for durable images, being the subject of a commonly-assigned U.S. patent application Ser. No. 689,980, filed Aug. 16, 1996, in the name of Francis Joseph Kronzer, entitled "Fusible Printable Coating for Durable Images" (incorporated herein by reference) addresses this issue by providing a system in which the printed ink can be fused and encapsulated by heating the coating to approximately 350 degrees F.

Generally described, the invention is directed towards an apparatus for imparting an image to a substantially flat media sheet including one side surface having a fusible layer at least partially thereon, the apparatus comprising a heated roller; a deformable roller rotatably mounted relative to the heated roller so as to define a heated nip area; and first and second endless belts having corresponding surfaces which coface each other and are of different textures, the first and second endless belts passing together through the nip area, such that when media sheet is introduced into the nip area, a different texture is imparted onto the one side surface depending upon which of the corresponding belt surfaces are in contact with the one side of the media sheet.

Therefore it is an object of the present invention to provide an improved fuser mechanism.

It is a further object of the present invention to provide an improved fuser mechanism for fusing aqueous-based ink-jet inks.

It is a further object of the present invention to provide an improved fuser mechanism for encapsulating aqueous-based ink-jet inks.

It is a further object of the present invention to provide an improved fuser mechanism which is simple to use.

It is a further object of the present invention to provide an improved fuser mechanism which is efficient in operation.

It is a further object of the present invention to provide a fusing mechanism and method for using same to be used in conjunction with thermally-fusible coatings.

It is a further object of the present invention to provide a fusing mechanism and method for using same which can provide a selection of surface textures without requiring mechanical changeover techniques.

It is a further object of the present invention to provide an overall printing and fusing mechanism and method for using same to be used in conjunction with thermally-fusible coatings.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

FIG. 8 illustrates the fuser cover in place.

DETAILED DESCRIPTION OF THE PREFERRED EMBODIMENT

Reference is now made to generally to FIGS. 1–12, in which like numeral indicate like elements throughout the several views.

General Construction and Operation

Figure 1:
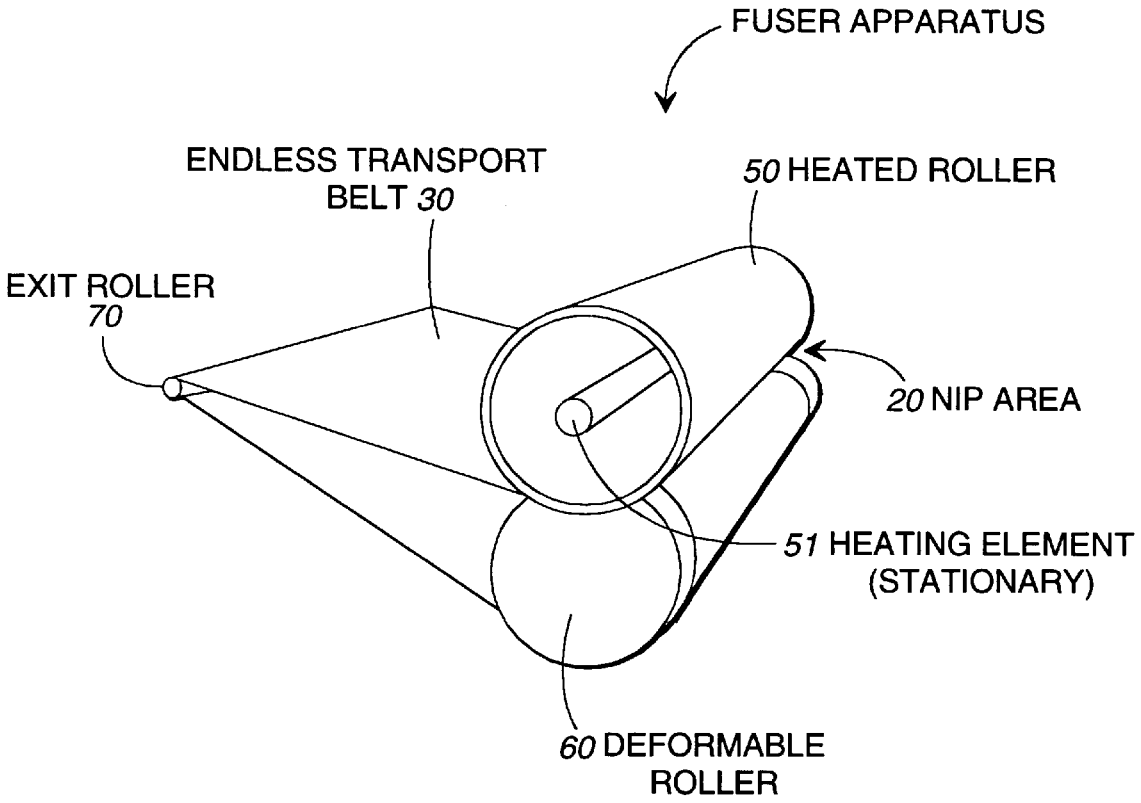
FIG. 1 is an isolated pictorial view of the primary elements of a fuser apparatus 10 according to a first embodiment of the present invention, in which the "paper path" is substantially horizontal, including a belt 30, a heated roller 50 heated by an internal stationary heating element 51, a deformable roller 60, and an exit roller 70.

Referring now to FIG. 1, the present invention generally includes the use of a fuser apparatus 10 including a nip area 20 and a transport web belt 30. Media coated with a thermally fusible coating is introduced into the nip area, such that heat and pressure is imparted thereto. The transport web belt 30 has a small enough thermal mass and a long enough length so that the then-fused coating thereon can adequately cool while adhering to the transport web belt 30 surface and then be peeled away from the surface at an exit roller 50. The fused coating encapsulates ink previously applied atop the coating during an otherwise conventional ink-jet printing process.

A method used in conjunction with the fuser apparatus 10 in which a coated media (such as paper, cloth, transparency or other media) is passed through the fuser, such that the fuser apparatus 10 applies heat and pressure to the media at a heated-roller nip. Such a process can be used to impart a surface texture to the media if so desired, to provide a barrier surface for the melted coating so that it does not adhere to the heated rollers, and to allow the resulting fused media to be peeled from the barrier surface after the coating has cooled below its melting temperature.

The Various Embodiments

The present invention is set forth in various embodiments.

FIG. 1 is an isolated pictorial view of the primary elements of a fuser apparatus 10 according to a first embodiment of the present invention, in which the "paper path" is substantially horizontal, including a belt 30, a heated roller 50, a deformable roller 60, and an exit roller 70.

Figure 2:
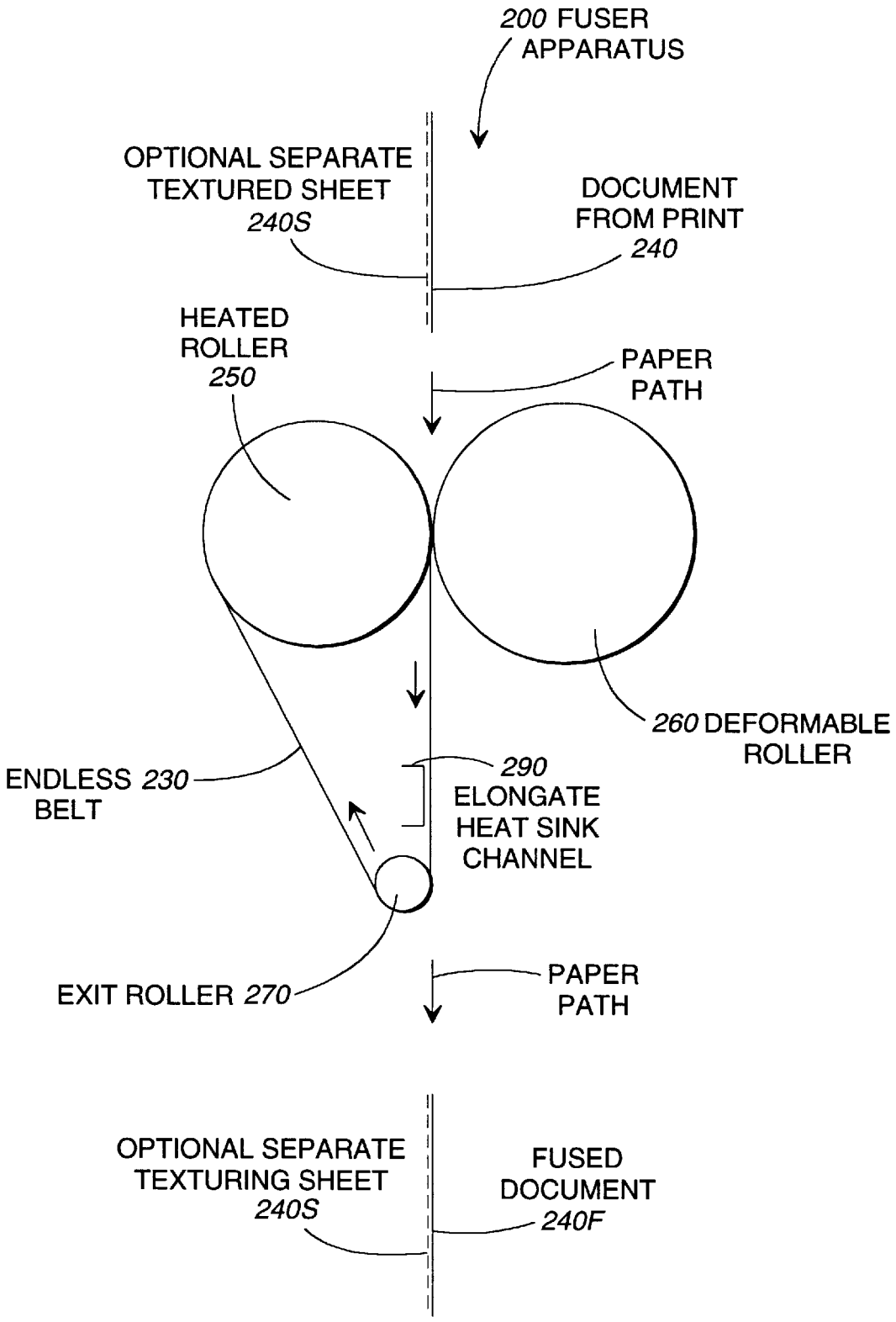
FIG. 2 is an isolated right side elevational view of the primary elements of a second embodiment fuser apparatus 200 of the present invention, in which the "paper path" is substantially vertical, which process a document 240 from a printer into a fused document 240F. Shown in phantom is an optional "texturing sheet" 240S which can be placed in registration with the document 240, to impart a texture different from that which would be imparted by the external surface of the endless belt 230.

FIG. 2 is an isolated right side elevational view of the primary elements of a second embodiment fuser apparatus 200 of the present invention, in which the "paper path" is substantially vertical, which process a document 240 from a printer into a fused document 240F. Shown in phantom is an optional "texturing sheet" 240S which can be placed in registration with the document 240, to impart a texture different from that which would be imparted by the external surface of the endless belt 230.

Figure 3:
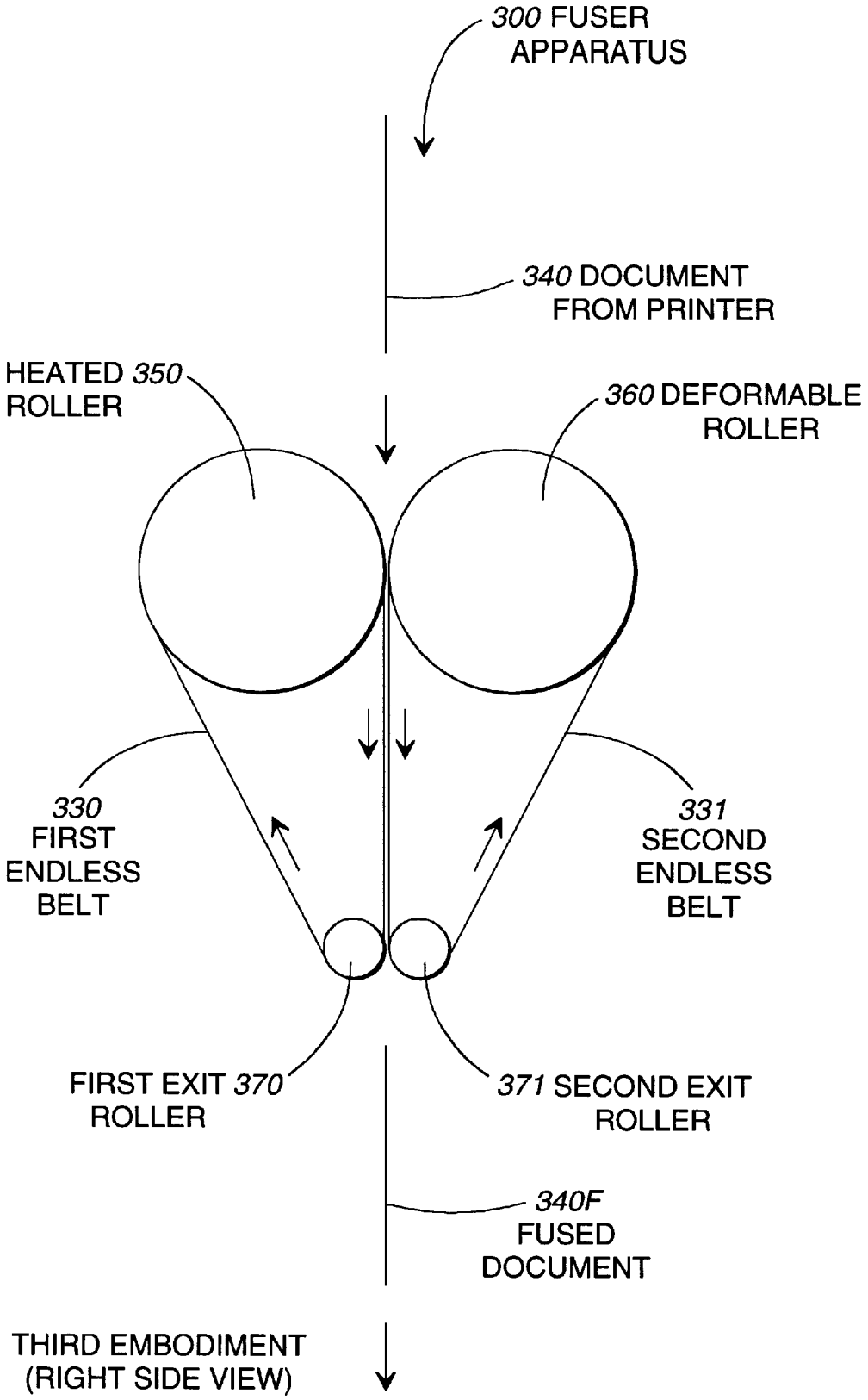
FIG. 3 is an isolated right side elevational view of the primary elements a third embodiment 300 of the present invention, in which the "paper path" is substantially vertical. This configuration is similar to the configuration of FIG. 2 except that it includes not one but two endless belts, which in the preferred embodiment include two different exposed surface textures for contacting the thermally-fusible coating on the media surface.

FIG. 3 is an isolated right side elevational view of the primary elements a third embodiment 300 of the present invention, in which the "paper path" is substantially vertical. This configuration is similar to the configuration of FIG. 2 except that it includes not one but two endless belts, which in the preferred embodiment include two different exposed surface textures for contacting the thermally-fusible coating on the media surface.

Figure 4:
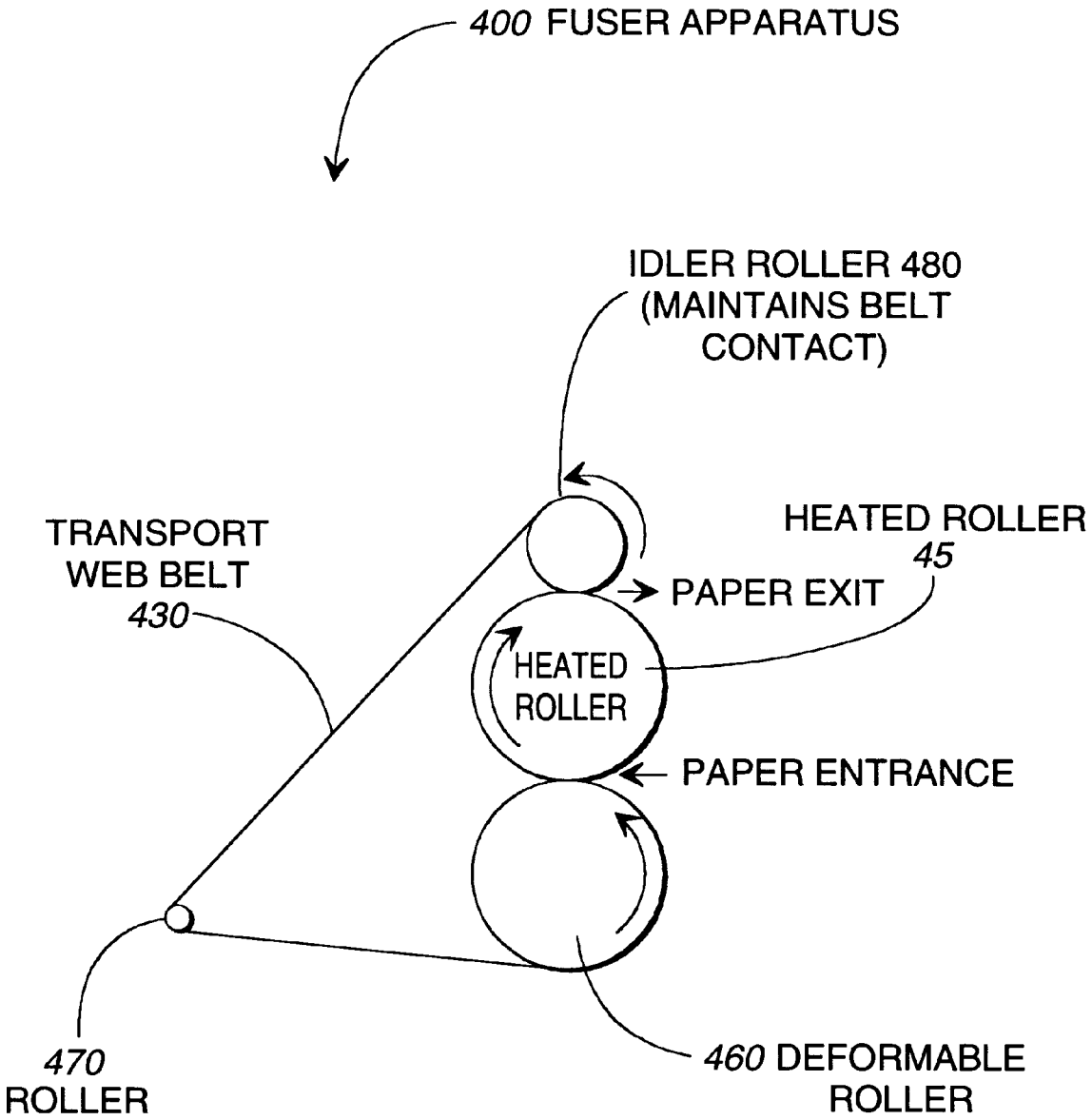
FIG. 4 is an illustrative right elevational side view of a portion of a fourth embodiment of the present invention, being a fuser apparatus 400, in which the paper path is serpentine.

FIG. 4 is an illustrative right elevational side view of a portion of a portion of a fourth embodiment of the present invention, being a fuser apparatus 400, in which the paper path is serpentine.

Figure 5:
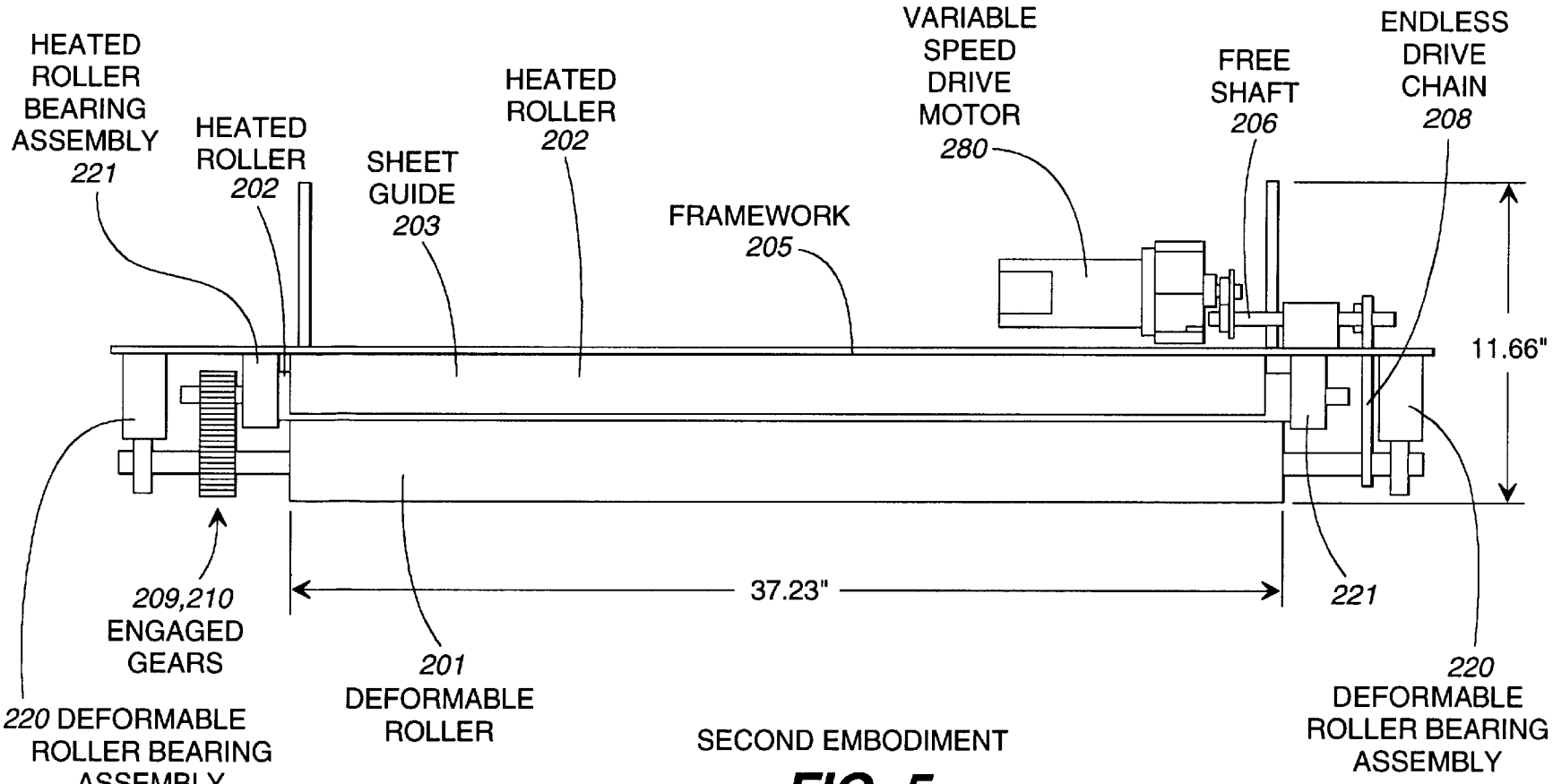
FIG. 5 is a top plan view of the second embodiment of the present invention, being a fuser apparatus 200, with its cover removed.

FIG. 5 is a top plan view of the second embodiment of the present invention, being a fuser apparatus 200, with its cover removed.

Figure 6:
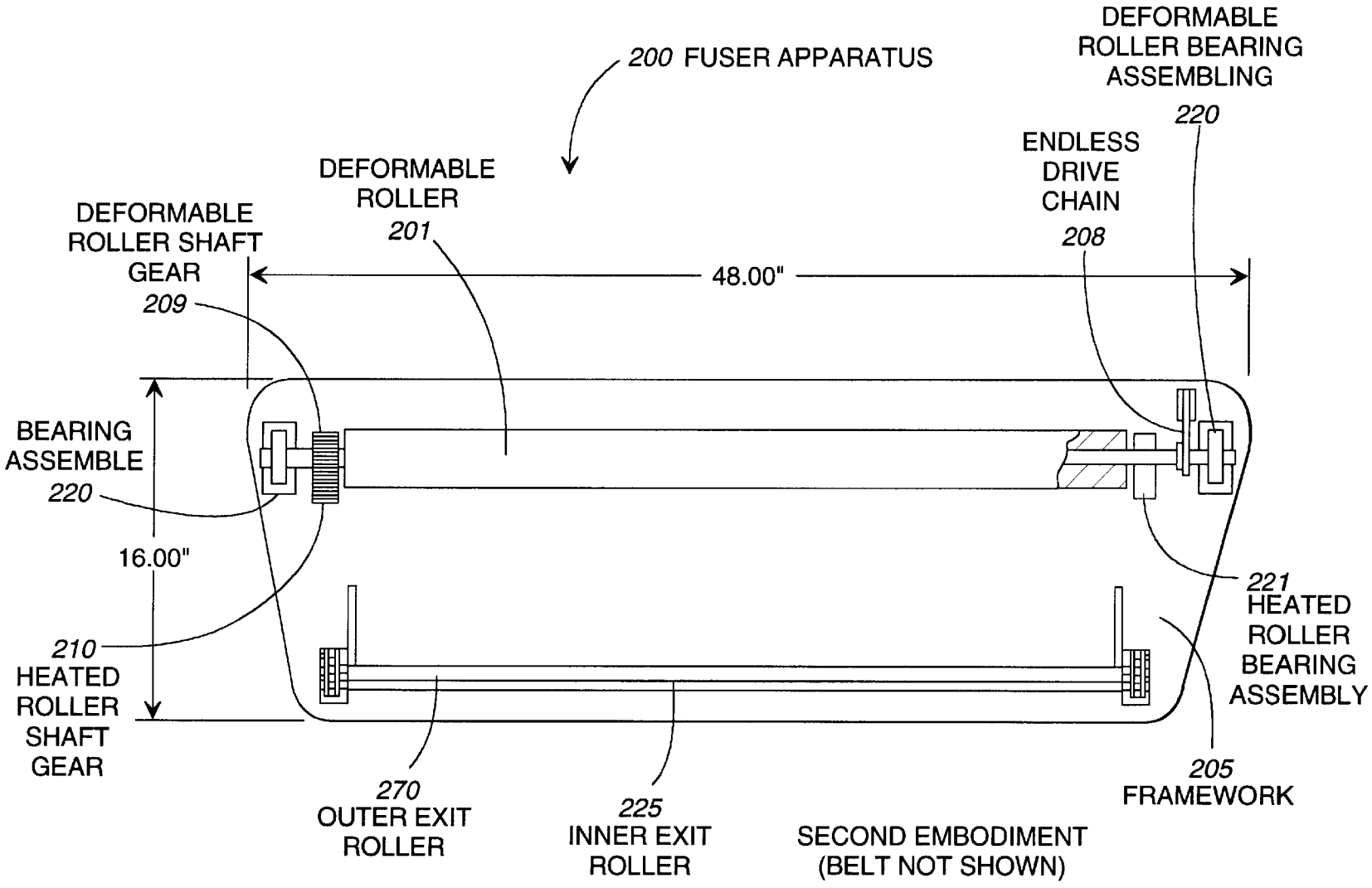
FIG. 6 is a front elevational view of the second embodiment of the present invention, being a fuser apparatus 200, with its cover removed, and with its deformable roller 201 shown in partial cross section.

FIG. 6 is a front elevational view of the second embodiment of the present invention, being a fuser apparatus 200, with its cover removed, and with its deformable roller 201 shown in partial cross section.

Figure 7:
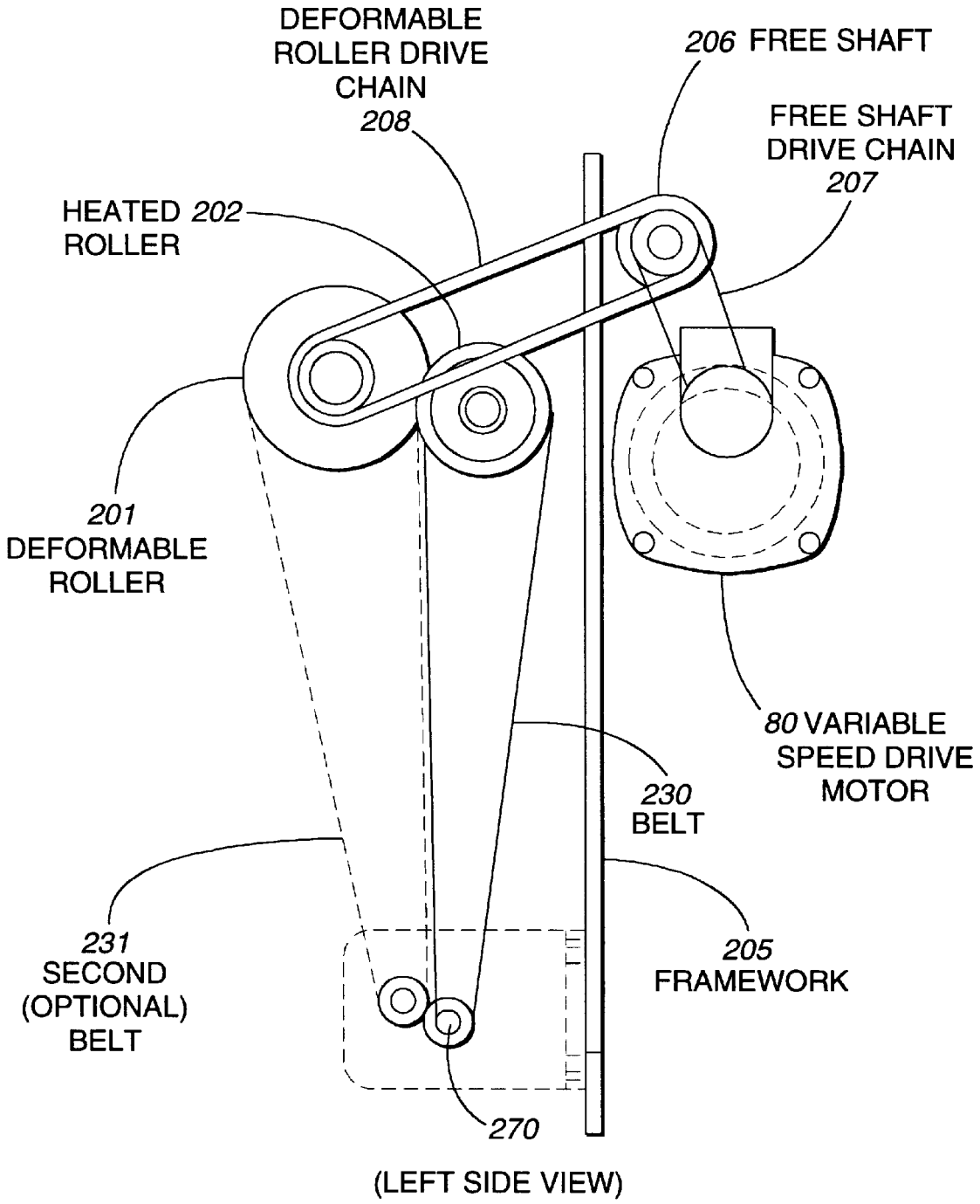
FIG. 7 is a left side elevational view of a portion of the second embodiment of the present invention, being a fuser apparatus 200, with its cover removed. An alternate second belt 231 is also shown in phantom.

FIG. 7 is a left side elevational view of a portion of the second embodiment of the present invention, being a fuser apparatus 200, with its cover removed. An alternate second belt 231 is also shown in phantom.

Figure 8:
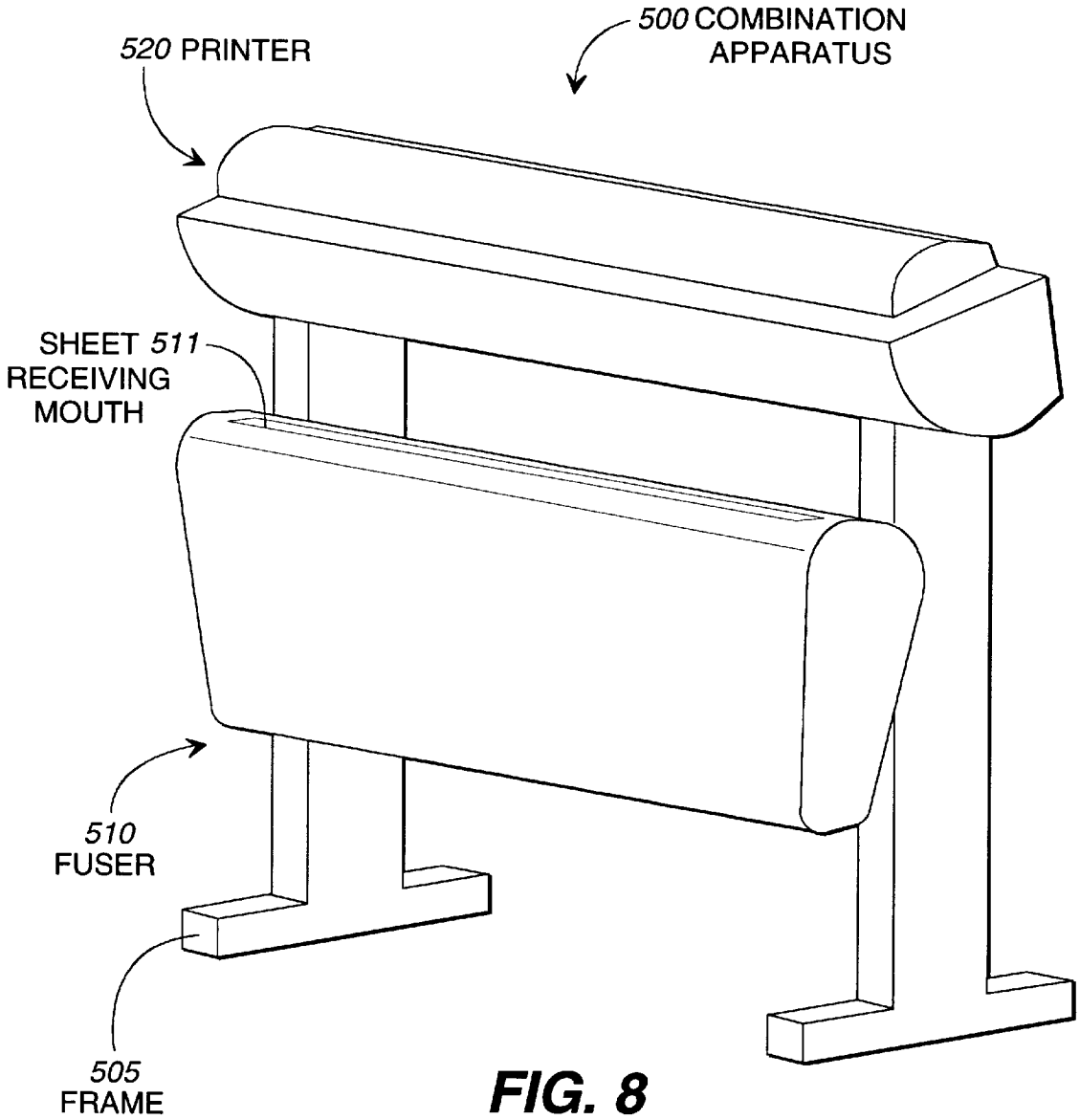
FIG. 8 is a perspective view of a fifth embodiment 500 of the present invention, in which a fuser 510 according to the present invention is used in conjunction with a printer 520, both of which are mounted to a frame 505.

FIG. 8 is a perspective view of a fifth embodiment 500 of the present invention, in which a fuser 510 according to the present invention is used in conjunction with a printer 520, both of which are mounted to a frame 505. FIG. 8 illustrates the fuser cover in place.

Figure 9:
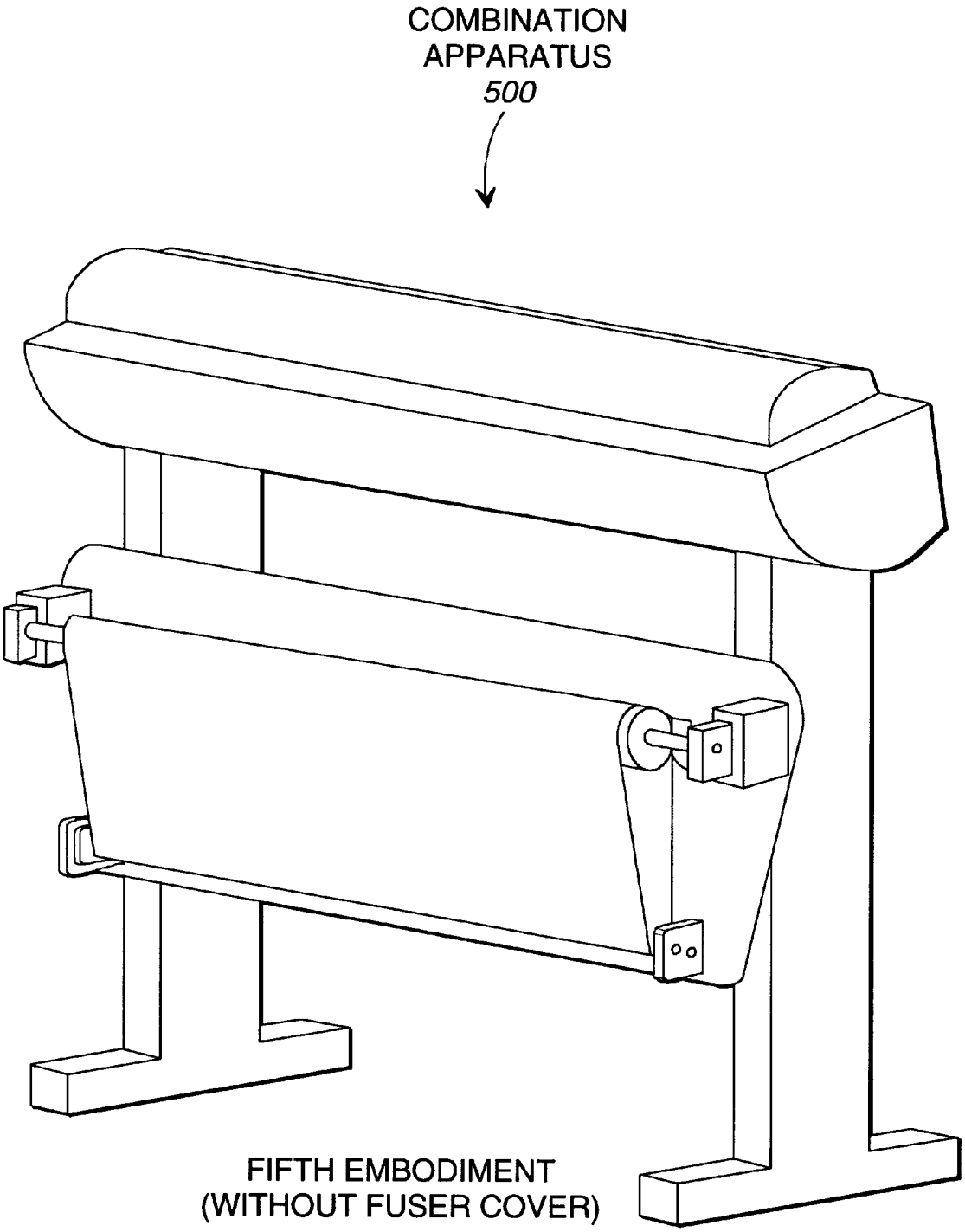
FIG. 9 is a view similar to that of FIG. 8, except the fuser cover is not in place.

FIG. 9 is a view similar to that of FIG. 8, except the fuser cover is not in place.

The First Embodiment—Apparatus 10

Reference is first made to FIG. 1, which shows a portion of a first embodiment of the fuser apparatus 10 according to the present invention which includes a heated-roller nip area 20 and a transport web belt 30. The heated-roller nip area 20 is defined by two cylindrical rollers 50, 60 pressed against each other and having substantially parallel longitudinal and rotational axes. At least one of the nip rollers contains a heating element, and the other roller may be pliable to increase the nip footprint.

The Various Rollers of the Apparatus 10

Various rollers are rotatably mounted relative to the framework of the fusing apparatus 10. These rollers include a heated roller 50, a deformable roller 60, and an exit roller 70.

In the embodiment shown in FIG. 1, roller 50 is heated. It is a heated roller 50 shaped as a hollow cylinder having a quartz infra-red heating element tube through the center to provide radiant heat to the roller surface, although other heating configurations are contemplated without departing from the spirit and scope of the present invention.

The heated roller 50 is rotatably mounted relative to the framework 12 of the fusing apparatus 10 such that its rotational axis is substantially horizontal, although other orientations are possible without departing from the spirit and scope of the present invention. The heated roller 50 is driven by an electric motor through a series of chain drives and gear arrangements as described later.

The deformable roller 60 is rotatably mounted relative to the framework 12 of the fusing apparatus 10 such that its rotational axis is substantially horizontal, although other orientations are possible without departing from the spirit and scope of the present invention. The deformable roller 60 is such as known in the art and includes a metal shaftlike core and an outer deformable layer and is driven through a series of reduction and chain drives by an electric motor as described later.

The exit roller 70 is rotatably mounted relative to the framework 12 of the fusing apparatus 10 such that its rotational axis is substantially horizontal, although other orientations are possible without departing from the spirit and scope of the present invention. The exit roller 70 is not a driving roller but is driven by the belts.

The Nip Area 20 of the Apparatus 10

The nip area 20 (see FIG. 1) is defined by the interaction of the heated roller 50 and the deformable roller 60.

The heated-roller nip area 20 is made of two cylindrical rollers 50, 60 pressed against each other. At least one of the nip rollers contains a heating element, and the other roller may be pliable to increase the nip footprint.

The Belt 30 of the Apparatus 10

The transport web belt 30 is, as known in the art, made of woven glass fibers which is TEFLON coated. The belt 30 wraps around one of the rollers 50, 60 but it has a much larger circumference than the roller, thereby, allowing a slack length of several inches. The slack in the transport web belt is taken up by a small radius exit roller 70 which serves to assist in the removal of the media from the transport belt and to help keep the belt taut.

The belt 30 must have a small enough thermal mass and a long enough length so that the fused coating thereon can adequately cool while adhering to the belt surface and then peel away from the surface at the exit roller.

In one configuration the belt 30 (and the other belts in the other embodiments) is composed of fiberglas coated with TEFLON, or other material known in the art for use in this art.

Use of Apparatus 10

The coated media is fed through the fuser with the coating side towards the transport web belt. Otherwise, upon heating, the hot, tacky coating would stick to the heated nip roller.

The speed should be high enough to melt the nylon but not bum the paper. The surface speed of the endless belt has been found to preferably be in the range of 5–50 cm/minute.

Second Embodiment

Reference is now made to FIGS. 2 and 5–7, which are several views of a second embodiment of the present invention, which differs primarily from the first embodiment of FIG. 1 in that the paper path is substantially vertical instead of horizontal.

Referring now also to FIGS. 5–7, the fusing apparatus 10 includes a stationary fusing apparatus framework 12 including a platelike portion, upon which various of its elements are attached. As noted later, this framework 12 may also be part of an overall substantially rigid framework which can support other apparatuses used in conjunction with the fusing apparatus 10, such as an upstream printer.

The moving parts of the fusing apparatus are driven by a variable speed DC motor 80, although other drive means are contemplated under the spirit and scope of the present invention. However, a DC motor was chosen because it allows for variable speed driving of the various rollers described herein, which can be of assistance in providing a desirable feed speed for the endless belt(s) which is slow enough to melt the nylon, but not so slow that the belt or the paper is burned.

FIGS. 5–7 show various drive elements for moving the various elements of the second embodiment of the present invention. The electric drive motor 280 has a shaft driving a sprocket which drives a chain 207 (see FIG. 7) which drives another sprocket which is attached to a free shaft 206 (see FIGS. 5 and 7) which is rotatably mounted relative to the framework 205 of the apparatus 200. Another sprocket attached to the free shaft 206 is linked via another endless chain 208 to a sprocket which is attached to the deformable roller 201. Therefore is may be seen that the drive motor 280 drives the deformable roller 260. All endless chains (as well as all belts) may include idler and take-up sprockets or rollers as known in the art.

As shown in FIGS. 6 and 7, At the opposite end of the deformable roller 201 is a first drive gear 209 which engages and drives a second drive gear 210 which is attached to the heated roller 202 (see FIGS. 5 and 7) through an engaged gear pair. Therefore it may be seen that the deformable roller 201 drives the heated roller 202. Preferably, the gear engagement is such that the surface speed of the deformable roller is substantially synchronized with the speed of the heated roller 202.

The exit roller 270 is not driven by the electric motor, but instead is driven by the endless belt 230.

It may be noted that FIG. 7 illustrates the option of using a second (optional) belt 231 which can be used in conjunction with the endless belt 230 to provide dual texture capability to a single apparatus as discussed in detail with respect to the third embodiment.

Third Embodiment

An alternative embodiment shown in FIG. 3 employs a double web belt system for fuser apparatus 300 including double-side media. By using two different webs 330, 331 having two different surface textures, at least two different textures can be imparted to the fused material on the document 340 depending on which surface is in contact during the fusion process, without necessitating any mechanical changeover techniques, resulting in a fused document 340F.

In this configuration, a second exit roller 371 and a deformable roller 360 are used to support the second belt 331. A first exit roller supports the first belt 330 along with a heated roller 350, in a manner similar to the previously described roller 270.

Fourth Embodiment

Still another alternative embodiment fuser apparatus 400 would position an additional idler roller 480 near the heated roller 450 to allow the transport belt 430 to serpentine and stay in contact with the heated roller longer, thereby increasing the dwell time. A roller 470 is also shown to take up slack. Process variations would include adjustable dwell time (i.e. belt speed, temperature, and pressure) and cool down time. A deformable roller 460 also supports the belt 430.

Fifth Embodiment

Reference is now made to FIGS. 8–9, which show a fifth embodiment 500 of the invention, being a combination apparatus 500 including a fuser 510 and a printer 520, both of which are mounted to a frame 505.

In such a configuration, the printer is contemplated as being an ink-jet printer such as known in the art, and the fuser is contemplated as being the second embodiment 200 described previously.

In such a configuration, there is a direct vertical drop downward of the media downward via gravity or direct feed into the fuser apparatus 510.

In such a configuration, it should be understood that nylon or other suitably treated paper would be processed through the printer 520.

It may be understood that some of such printers have their own heating element, but it is only used to chase off water or solvents to prevent smudging, and does not provide a temperature suitable for melting.

Other Contemplated Embodiments and Uses

It should be understood that variations and modifications to the above embodiments may be effected without departing from the spirit and scope of the present invention. For example, as shown by the phantom element 240-S of FIG. 2, if a piece of mylar or other suitable material is placed over the coating before it is run through the fuser, a nice, smooth, satin finish may be provided. This would allow a single belt apparatus to be capable of imparting multiple surface textures, including not only the basic texture provided by the transfer belt, but, depending upon the textures selected, relatively smoother or rougher textures provided by the use of a separate sheet such as the mylar discussed above.

The Heat Sink 90

As shown in FIG. 2, an elongate heat sink channel 290 in the form of an elongate bar, which can have the U-shaped transverse cross section or alternately an "L"-shaped cross section (not shown). The heat sink has a continuous belt-contacting surface and oppositely-extending heat-dissipating "fingers" defined by elongate transverse slots therebetween. Air can be blown past the fingers if desired.

As may be understood, when the belt is heated, it tends to expand laterally, and this can be a difficulty in that thermal expansion can cause ripples in the belt. Therefore the elongate heat sink 90 can also be used as a "snugger", which tends to take some of the ripples in the belt, caused by differentials in heat transfer.

Dimensions

The outside diameter of the heated rollers in the embodiment 200 is 2 inches.

The outside diameter of the deformable roller in the embodiment 200 is 3 inches.

The outside diameter of the exit roller in the embodiment 200 is 0.75 inches.

Materials

The heated roller can be of steel pipe construction.

The deformable roller can be of a vulcanized rubber construction.

The cooling fin can be made of aluminum.

The exit rollers can be of steel pipe construction.

The fusing belts can be such as those known in the art, including being of woven glass fibers covered with TEFLON having a thickness of 5 to 30 mils with 10 to 20 mils most preferable, such as those provided by Astechnologies in Roswell, Ga. A seamless belt is preferred if economically feasible.

Advantages

Therefore it may be seen that the present invention provides a fusing mechanism and method for using same, for fusing thermally-fusible coatings in which a separate release layer sheet is not required, a surface texture (smooth or canvass) can be imparted to the fused coating, and "self-peeling" of the finished media from a transport web belt is made possible.

Conclusion

While this invention has been described in specific detail with reference to the disclosed embodiments, it will be understood that many variations and modifications may be effected within the spirit and scope of the invention as described in the appended claims.

What is claimed is:

1. A method of imparting an image to two separate substantially flat media sheets each including one side surface having a fusible layer at least partially thereon, said method comprising the steps of:

A) providing an apparatus comprising;
  1) a heated roller;
  2) a deformable roller rotatably mounted relative to said heated roller so as to define a heated nip area; and
  3) two endless belts having corresponding surfaces which coface each other and are of different textures, said endless belts passing together through said nip area, B) introducing said sheet into said nip area at a first orientation such that said fusible paper coating on said one side is contacted with the outwardly facing side of said first belt and is imparted with a first corresponding texture; and C) introducing said second sheet into said nip at a second orientation such that said fusible paper coating on said one side is contacted with the outwardly facing side of said second belt and is imparted with a second corresponding texture.

2. The method as claimed in claim 1, further comprising the step of using an intermediate texturing sheet having a sheet texture different than said either of said textures of said two endless belts to provide a texture on said fusible layer corresponding to said texturing sheet texture.

3. The method as claimed in claim 2, wherein step "A" further comprises the provision of an apparatus for applying an aqueous-based ink to said fusible paper coating.

4. The method as claimed in claim 1, wherein step "A" further comprises the provision of an apparatus for applying an aqueous-based ink to said fusible paper coating.

5. A method of imparting an image to two separate substantially flat media sheets each including one side surface having a fusible layer at least partially thereon, said method comprising the steps of:

A) providing an apparatus comprising:
  1) a heated roller;
  2) a deformable roller rotatably mounted relative to said heated roller so as to define a heated nip area; and
  3) an endless belt configured to pass through said nip area and having an outer belt surface having a belt surface texture;

B) providing an intermediate sheet having a sheet surface texture different than said belt exterior texture;

C) introducing said first media sheet into said nip area such that said fusible layer of said first media sheet is imparted with a first surface texture; and D) introducing said second media sheet and said intermediate texturing sheet together into said nip area such that said fusible layer of said second media sheet is imparted with a second surface texture corresponding to that of said intermediate texturing sheet.

6. The method as claimed in claim 5, wherein the intermediate texturing sheet is in contact with said compressible roller when passing through said nip.

7. The method as claimed in claim 5, wherein said intermediate texturing sheet is in contact with said heated roller when passing through said nip.

8. The method as claimed in claim 5, wherein step "A" further comprises the provision of first and second endless belts each having separate surface textures, such that three separate surface textures are possible by use of said first and second endless belts and said intermediate texturing sheet.

9. The method as claimed in claim 5, wherein during step "A" further comprises the provision of an apparatus for applying an aqueous-based ink to said fusible paper coating.

10. A method of imparting an image to a substantially flat media sheet including one side surface having a fusible layer at least partially thereon, said method comprising the steps of:

providing a printer and a fuser each attached to a framework; and introducing said item to said printer, such that said flat media sheet is passed through said printer, receives a printed image thereon, and thereafter passed to a fuser to be fused thereby, wherein said printer is located above said fuser such that during said method said flat media sheet drops from said printer into said fuser by gravity.

11. The method as claimed in claim 10, wherein said step of providing said fuser includes the step of providing at least one endless belt made at least in part of glass fibers.

12. The method as claimed in claim 11, wherein said step "A" further comprises the step of providing an apparatus for applying an aqueous-based ink to said fusible paper coating prior to its introduction into said printer.

13. An apparatus for imparting an image to a substantially flat media sheet including one side surface having a fusible layer at least partially thereon, said apparatus comprising:

a framework;

a printer attached to said framework; and a fuser attached to said framework and located under said fuser, said fuser and said printer configured such that said substantially flat media sheet passes through said printer, receives said image thereon, and thereafter drops into said fuser by gravity to be fused thereby, said fuser including a pair of endless belts each passing through a common nip area and each defining a different surface texture such that when media sheet is introduced into said nip area, a different texture is imparted onto said one side surface depending upon which of said corresponding belt surfaces are in contact with said one side of said media sheet.

* * * * *